US005535514A

United States Patent [19]

Lucas

[11] Patent Number: 5,535,514

[45] Date of Patent: Jul. 16, 1996

[54] METHOD FOR MAKING A HYDRAULIC DOOR CLOSER HAVING A ONE-PIECE MOLDED HOUSING BODY

[75] Inventor: Craig L. Lucas, Princeton, Ill.

[73] Assignee: Schlage Lock Company, San Francisco, Calif.

[21] Appl. No.: 289,040

[22] Filed: Aug. 11, 1994

[51] Int. Cl.[6] ..... E05F 3/00; H01R 43/00

[52] U.S. Cl. ..... 29/888.06; 16/62; 29/428; 29/527.1; 188/285; 188/322.15; 188/322.19; 251/58

[58] Field of Search ..... 16/54, 58, 62, 16/DIG. 9, DIG. 7, DIG. 21; 49/137, 352; 251/58, 66, 73, 294, 331; 188/285, 286, 322.15, 322.19; 29/428, 527.1, 888.06

[56] References Cited

U.S. PATENT DOCUMENTS

| | | | |
|---|---|---|---|
| 1,178,688 | 4/1916 | Stronach | 16/62 |
| 3,054,136 | 9/1962 | Schlage et al. | 16/62 |
| 3,426,383 | 2/1969 | Lasier et al. | 16/62 |
| 3,546,734 | 12/1970 | Pollack et al. | 16/62 |
| 3,822,438 | 7/1974 | Takenaka | 16/62 |
| 4,234,996 | 11/1980 | Jentsch | 16/62 |
| 4,285,094 | 8/1981 | Levings, Jr. | 16/52 |
| 4,386,446 | 6/1983 | Zunkel et al. | 16/58 |
| 4,665,583 | 5/1987 | Frolov et al. | 16/62 |
| 5,121,686 | 6/1992 | Schonlau et al. | 92/163 |

FOREIGN PATENT DOCUMENTS

| | | | |
|---|---|---|---|
| 690277 | 7/1964 | Canada | 16/62 |

*Primary Examiner*—W. Donald Bray
*Attorney, Agent, or Firm*—Robert F. Palermo

[57] ABSTRACT

A method for making a hydraulic door closer includes the steps of molding material to form an elongated single-piece housing having a longitudinal cylindrical bore extending from a first open end thereof to a closed second end, a transverse intersecting bore, and mounting feet; installing a spring within the cylindrical bore at the closed end of the housing; installing a piston within the cylindrical bore in contact with the spring, the piston having a toothed rack thereon and an opening in each end to permit passage of fluid therethrough; installing a pinion gear in the transverse intersecting bore in meshed engagement with the toothed rack; installing an endplug with a port in the first end of the longitudinal cylindrical bore; and inserting a valve device through the port, for controlling flow of fluid through the piston, and for thereby controlling closing speed of the door. The single-piece housing as well as other components may be molded from metal or polymeric materials. Polymeric materials are preferred for their flexibility, lubricity, and moldability.

13 Claims, 3 Drawing Sheets

METHOD FOR MAKING A HYDRAULIC DOOR CLOSER HAVING A ONE-PIECE MOLDED HOUSING BODY

BACKGROUND OF THE INVENTION

This invention relates generally to door closers and more particularly to a method for making door closers which are designed for economical manufacture by molding and for simple assembly by reduction of the number of parts and elimination of secondary machining operations.

FIG. 1 shows a door closer 10 of the prior art to be assembled from a large number of parts. A housing body 11 is threaded 22 to a spring housing 12. Endplug 14 and spring plug 13 are likewise threaded 21, 23 to housing body 11 and spring housing 12, respectively. Pinion 16 engages the rack (not shown) of piston 15 and is held in place in housing body 11 by two packing nuts 17 which provide support for the pinion shaft seals (not shown) and bearings 18.

Housing body 11 is drilled and cross drilled for fluid ports (not shown) through which fluid flow is controlled by needle valves (not shown) to regulate door closing and latching speeds. Other designs of door closers are in use, one such device being substantially as described in U.S. Pat. No. 4,386,446, granted Jun. 7, 1983 to Zunkel, et al and commonly assigned herewith. For details of construction and operation of door closers, the specification ('446) Patent is incorporated herein by reference.

Although this general design has been in use in various forms for a long time, and although it provides door closers of excellent strength and durability, it is costly and time consuming to perform the many machining, finishing, and assembly operations. These many operations also introduce a high probability for error with resultant scrap losses. For example, both ends of the housing body and the spring housing as well as the end plugs must be threaded in order to be assembled together. In addition, the transverse pinion bore must be threaded at both ends to receive the externally threaded packing nuts, and the bores of the nuts must also be finished to close tolerance to accommodate the bearings. The drilling, cross-drilling, and tapping of the fluid ports in the housing body and the drilling, ball seating, and staking of the check valves in the piston ends are also costly and time consuming precision machining operations required by the design. Clearly, the greater the degree of precision required by any machining, the greater is the risk of a discrepant result and attendant rework and scrap losses.

The foregoing illustrates limitations known to exist in present hydraulic door closers, and it would be advantageous to provide an alternative directed to overcoming one or more of those limitations. Accordingly, a suitable alternative is provided including features more fully disclosed hereinafter.

SUMMARY OF THE INVENTION

A method for making a hydraulic door closer, for mounting on a door, includes the steps of molding material to form an elongated single-piece housing, the housing having at least one open end and a longitudinal cylindrical bore extending from the at least one open end to a second end, a transverse intersecting bore, and mounting feet; installing an endplug, if required, in the second end of the housing; installing a spring within the cylindrical bore at the second end of the housing; installing a piston within the cylindrical bore in contact with the spring, the piston having an opening in each end thereof to permit passage of fluid therethrough and a toothed rack thereon; installing a pinion gear in the transverse intersecting bore in meshed engagement with the toothed rack; installing an endplug with a port in the longitudinal cylindrical bore at the first end of said housing; and inserting valve means through the port and through a first end of the piston, for controlling flow of fluid through the piston, and for thereby controlling closing speed of the door.

The foregoing and other aspects of the invention will become apparent from the following detailed description, when considered in conjunction with the accompanying drawings.

DETAILED DESCRIPTION

Figure 1:
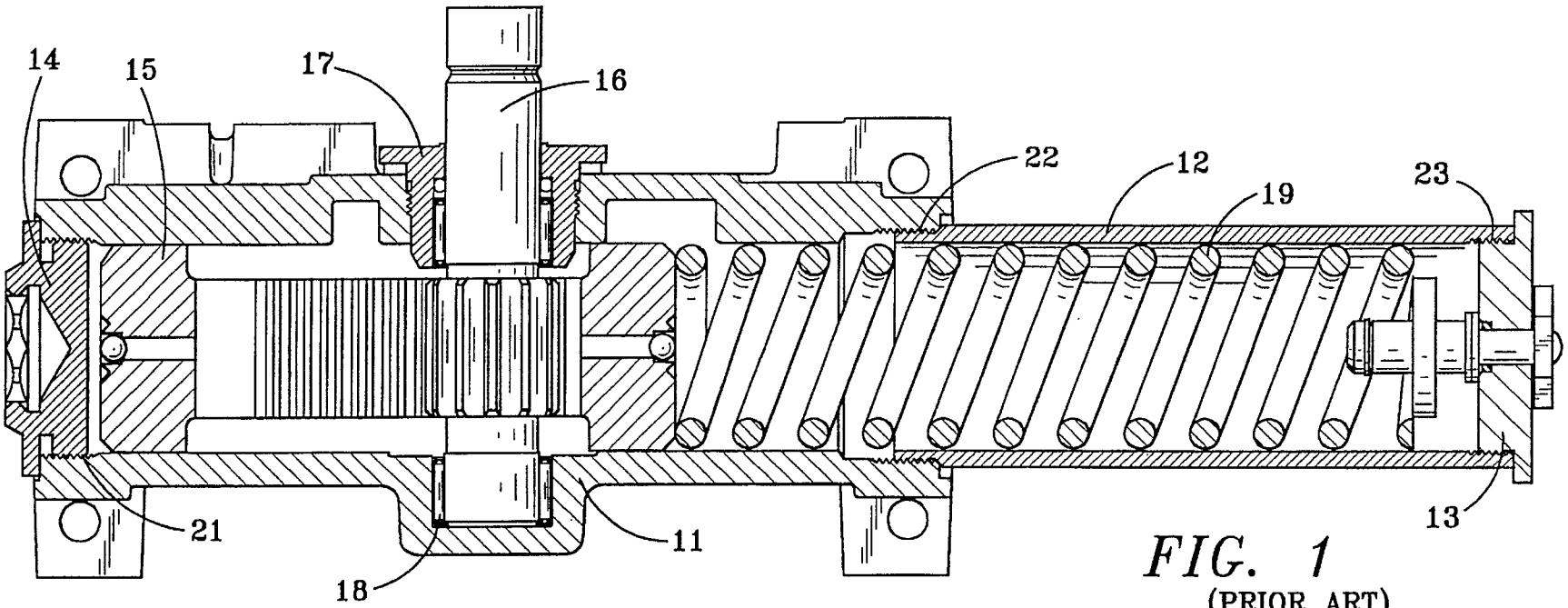
FIG. 1 (PRIOR ART)
FIG. 1 is a longitudinal cross-sectional schematic view of a typical door closer of the prior art.
Figure 2:
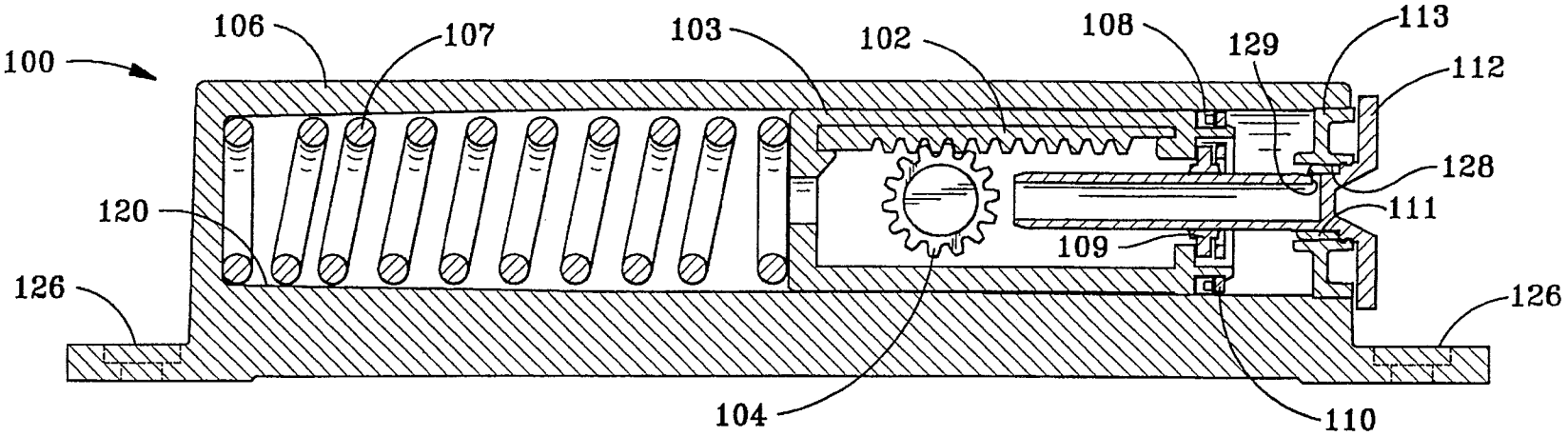
FIG. 2 is a longitudinal cross-sectional schematic view illustrating a preferred embodiment of a door closer made according to the methods of the present invention.
Figure 3:
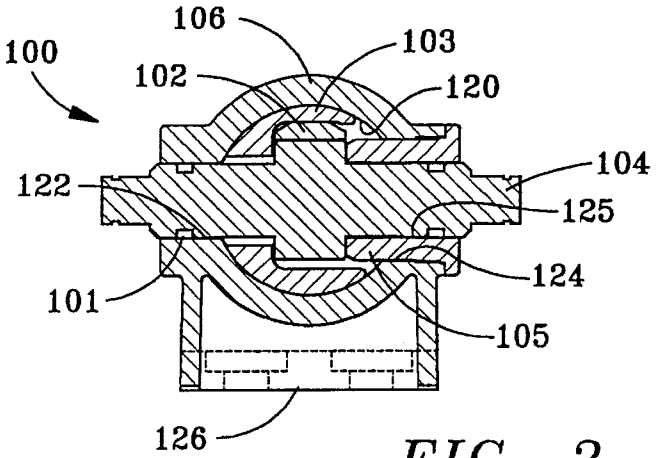
FIG. 3 is a transverse cross-sectional view showing further detail of the rack and pinion installation.

FIGS. 2 and 3 show longitudinal and transverse cross-sectional schematic views, respectively, of the preferred embodiment of the invention. Door closer 100 is made up of housing 106 which is formed as a single piece and, preferably, has a longitudinal cylindrical bore 120 extending from an open first end to a closed second end, a transverse bore 122, 124 providing access for installation of pinion 104 and packing plug 105, and mounting feet 126. The housing can also be formed with both ends open, but except where access from both ends is required, it is easier and less costly to mold the housing with one end closed and one end open. Packing plug 105 fits into bore 124 and has an internal bore 125 which provides a bearing surface together with bore 122 for pinion 104. Two "O"-rings 101 seal the pinion shaft in the two bores, and the packing plug 105 is itself sealed and fastened in place by adhesive or solvent welding or, preferably, by ultrasonic welding.

A spring 107 is positioned in bore 120 at the closed end of housing 106, and a piston 103 rests against the spring. The piston 103 has a toothed rack 102 longitudinally attached to one side of the piston (in this embodiment, inside the piston) and an opening in each end for permitting passage of fluid therethrough when the piston reciprocates in the cylindrical bore 120. Rack 102 is meshed with pinion 104 so that, when piston 103 slides in bore 120, pinion 104 must rotate, and vice-versa. Thus, when the door is opened, the door closer arm (not shown) causes pinion 104 to rotate and to drive rack 102 together with piston 103 leftward in FIG. 2 against spring 107. When the door is released, spring 107 forces piston 103 rightward thereby turning pinion 104 to swing the closer arm and close the door.

To keep the door from slamming, bore 120 is filled with hydraulic fluid and, by causing the fluid to flow through restricted orifices when displaced by piston 103, a viscous damped motion is imposed upon the door when it is opened or closed. Regulating valve 112 extends through port 128 of endplug 113 into the opening in the end of piston 103. A cap seal 109 fits snugly around the tube of valve 112 and occludes the opening in the piston to prevent flow of fluid through it. Retaining ring 110 holds lip seal 108 and cap seal 109 on the end of the piston 103, thereby assuring that substantially all fluid flow through the piston comes from the tube of regulating valve 112 when the piston moves in the cylinder bore 120.

The tube of valve 112 has an orifice 129 through its wall near the endplug 113. When the valve is turned, the orifice 129 is brought into greater or lesser registration with endplug seal 111, which has a non-constant axial extent around its circumference, to permit less or more fluid flow, respectively, through the tube and the piston 103. This regulates the speed of travel for the door when opening and closing.

Endplug 113 also is sealed to housing 106 and fastened in place in cylindrical bore 120 by adhesive bonding, solvent welding, or preferably by ultrasonic welding. Port 128 has a knurled, or otherwise non-smooth, surface so that, when valve 112 with endplug seal 111 is pressed into the port, the valve is free to turn within seal 111, but the seal is fixed in port 128. This permits the relative motion between orifice 129 and seal 111 which is necessary for varying the fluid flow. The valve is held in place by a snap fit between congruent ridges and grooves on the outside of the valve and on the inside of the port.

The elastic modulus of the molded polymer is low enough that, when subjected to excessive forces, the molded parts deform sufficiently to permit leakage of hydraulic fluid through the opening in piston 103 around the tube of valve 112 and through orifice 129 of valve 112 through the endplug seal 111 to relieve peak stresses in the closer and to thereby protect the closer and the door from damage. Note that the leakage described is totally within the housing between the opposite ends of the piston 103. This design feature, together with the other novel features disclosed herein, is made possible by the elasticity, the lubricity, and the moldability of polymeric materials.

The novel regulating valves of this embodiment and the alternative embodiment are the subject of a co-pending application Ser. No. 08/289,478, filed Aug. 14, 1994 and commonly owned herewith.

Figure 4:
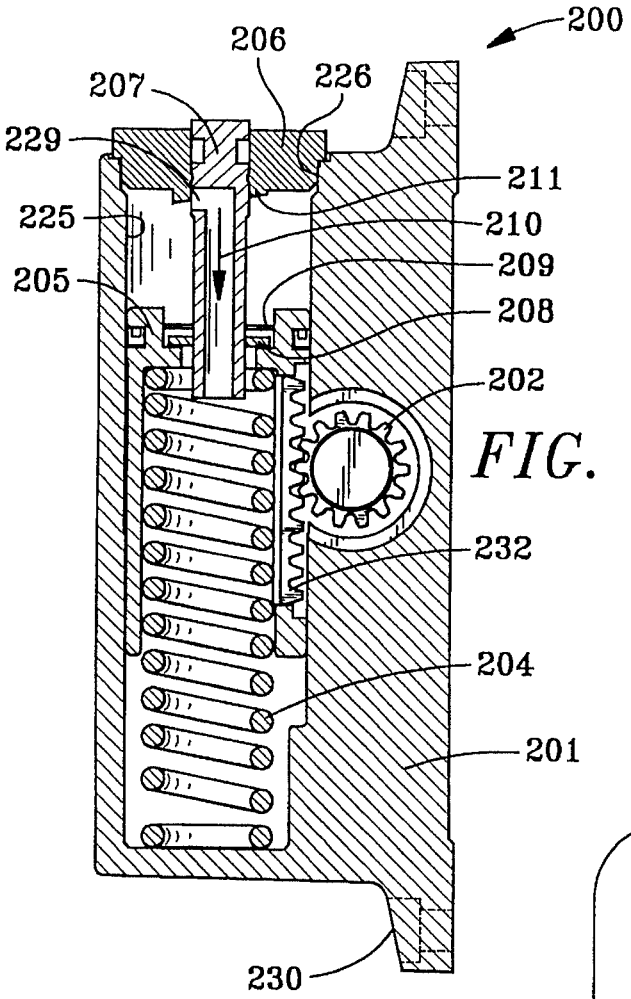
FIG. 4 is a longitudinal cross-sectional schematic view illustrating an alternative embodiment of a door closer of the present invention.
Figure 5:
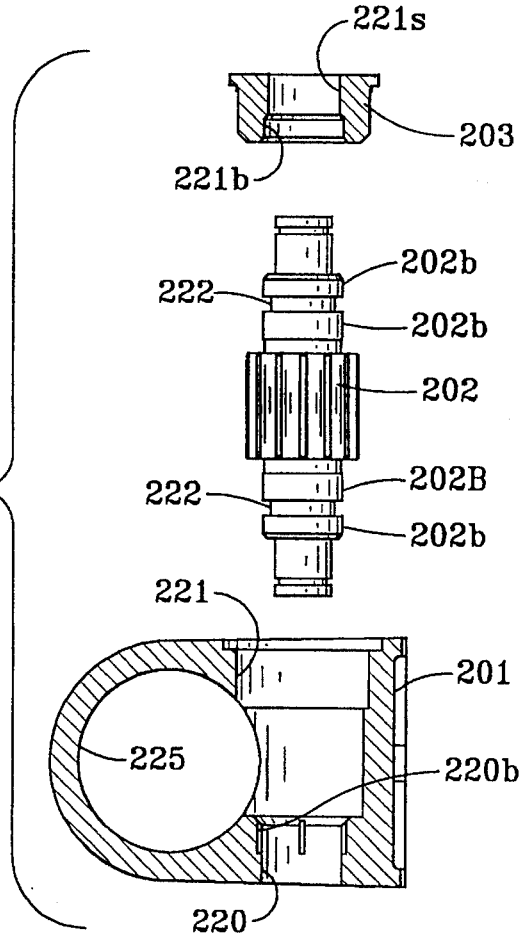
FIG. 5 is a transverse cross-sectional exploded view showing detail of the rack and pinion installation for the alternative embodiment.

FIGS. 4 and 5 illustrate another embodiment of a door closer 200 designed for and made by the method of the present invention. Two major differences between this embodiment and the embodiment in FIGS. 2 and 3 are the external rack on the piston 205 and, as a consequence of that rack location, the ability to locate the spring 204 inside the piston. This allows the shorter cylinder design shown here for the same piston travel, which greatly simplifies molding and ejection, and results in a potential saving of materials and other resources.

Because the rack is on the outside of piston 205, in this case it is not necessary to install the piston before pinion 202 as is the case when the rack is on the inside of the piston. To install pinion 202, seals (not shown) are placed in seal grooves 222 of the pinion shaft, and the pinion is inserted into bores 220 and 221. No bearings are used because the polymer has sufficient lubricity to provide a bearing function between shaft surfaces 202b and bore surfaces 220b and 221b. Packing plug 203 is installed over the top pinion shaft and inserted into bore 221 where it is preferably ultrasonically welded in place.

Spring 204 and piston 205 are inserted into bore 225 of housing 201 with the teeth of rack 232 engaged with those of pinion 202. Before inserting the piston, seal plate 208 and retaining ring 209 are assembled over the opening in the end of piston 205 so that, after endplug 206 is inserted and welded in place and the hydraulic fluid is installed, regulating valve 207 can be inserted through the endplug and the seal plate 208 to control fluid flow through the piston in the same way that valve 112 does in the embodiment of FIG. 2. Again valve 207 is held in place by a snap-in fit between matching ridges and grooves on the outer surface of the valve and the inner surface of the endplug. A seal is provided on the valve in the endplug bore. In this case, orifice 229 registers with lip 211 on endplug 206 to a lesser or greater degree to provide greater or lesser fluid flow, respectively, through piston 205.

This embodiment also provides the same protection against pressure surges caused by excessive forces due to too rapid operation of the door. Again, the elasticity of the polymer together with its low elastic modulus, permits instantaneous relief of excessive pressure spikes by permitting a slight leakage of fluid around the valve through seal plate 208 of the piston. Since the fluid is not compressible, only a tiny relief leak is needed to reduce pressure to a safe level.

The invention has been described in its preferred configuration as providing a one-piece molded housing and, for purposes of easy molding, fluid transfer through the piston during opening and closing of the door. It is also contemplated that, for some applications, it may be preferable to provide for fluid transfer around the piston by providing a port extending longitudinally through the housing wall into the pinion bore (not shown) and inserting valve 207 there rather than through the endplug and piston head. All other features of operation would remain the same, but the piston head would be solid except, possibly, for inclusion of a check valve.

What is claimed is:

1. A method for making a hydraulic door closer, for mounting on a door, comprising the steps of:

molding material to form an elongated single-piece housing, said housing having at least one open end and a longitudinal cylindrical bore extending from said at least one open end thereof to a second end, a transverse intersecting bore, and mounting feet;

installing an endplug, if required, in said second end of said housing;

installing a spring within said cylindrical bore at the second end of said housing;

installing a piston within said cylindrical bore in contact with said spring, said piston having a toothed rack thereon;

installing a pinion gear in said transverse intersecting bore in meshed engagement with said toothed rack;

installing an endplug in the longitudinal cylindrical bore at the first end of said housing; and inserting valve means, through a longitudinal port, for controlling transfer of fluid around said piston, and for thereby controlling closing speed of said door.

2. The method of claim 1, wherein said elongated single-piece housing is molded with one open end and one closed end.

3. The method of claim 1, wherein said elongated single-piece housing and said end plug are molded from a polymeric material.

4. The method of claim 1, wherein said piston is molded from a polymeric material.

5. The method of claim 3, wherein said piston is molded from a polymeric material.

6. The method of claim 3, wherein said toothed rack and said pinion gear are both made from metal.

7. A hydraulic door closer for mounting on a door, comprising:

an elongated housing, said housing having an open first end and a longitudinal cylindrical bore extending from said open first end thereof to a second end, a transverse intersecting bore, and mounting feet, said housing being formed as a single-piece;

a spring disposed within said cylindrical bore at the second end of said housing;

a piston within said cylindrical bore in contact with said spring, said piston having a toothed rack thereon and an opening in each end to permit passage of fluid therethrough;

a pinion gear in meshed engagement with said toothed rack;

an endplug with a port at the first end of said housing;

valve means, extending through said port and through a first end of said piston, for controlling flow of fluid through said piston, and thereby controlling closing speed of said door.

8. The hydraulic door closer of claim 7, wherein said single piece housing is formed from molded polymeric material.

9. The hydraulic door closer of claim 7, wherein said single piece housing is formed from molded metal.

10. The hydraulic door closer of claim 8, wherein said piston and said endplug are formed from molded polymeric material.

11. The hydraulic door closer of claim 9, wherein said piston, said pinion, and said endplug are formed from metal.

12. The hydraulic door closer of claim 10, wherein said endplug is attached to said housing by welding.

13. The hydraulic door closer of claim 7, wherein said valve means, extending through said port and through a first end of said piston, comprises an elongated tubular member having a first open end and a second closed end, an orifice in a sidewall adjacent said closed end, a smooth external surface extending through a seal plate in said piston, said seal plate having a smooth inside surface with a sliding fit over said tubular member, and means in said port for occluding varying portions of said orifice in response to rotation of said valve and for thereby regulating flow of fluid through said piston.

* * * * *